US005591000A

United States Patent [19]

Fischer

[11] Patent Number: 5,591,000

[45] Date of Patent: Jan. 7, 1997

[54] COMPRESSOR UNIT

[75] Inventor: Peter Fischer, Bad Neustadt, Germany

[73] Assignee: Siemens Aktiengesellschaft, Munich, Germany

[21] Appl. No.: 561,576

[22] Filed: Nov. 21, 1995

[30] Foreign Application Priority Data

Jan. 5, 1995 [DE] Germany ..... 19500469.8

[51] Int. Cl.[6] ..... F04D 5/00

[52] U.S. Cl. ..... 415/55.5; 415/214.1

[58] Field of Search ..... 415/55.1, 55.5, 415/214.1

[56] References Cited

U.S. PATENT DOCUMENTS 4,204,800 5/1980 Bentele et al. ..... 415/55.5
4,299,536 11/1981 Sieghartner et al. ..... 415/55.5

FOREIGN PATENT DOCUMENTS 186095 8/1987 Japan ..... 415/55.5

*Primary Examiner*—John T. Kwon
*Attorney, Agent, or Firm*— Kenyon & Kenyon

[57] ABSTRACT

A compressor unit is provided, which has at least two side-channel compressors arranged axially next to one another, and in which housing halves within each compressor each have, on a housing wall extending between an axially extending hub extension and a housing protrusion caused by a side channel, an axial extension 11. Side-channel compressors of different sizes can be assembled into a unit by the fact that the axial extension extends in each case into the parting plane of the housing halves, and is in each case equipped with a centering rim, projecting beyond the parting plane that mates with a centering step provided on the axial extension of the adjacent housing half and standing back from the parting plane. The inner housing halves are attached to one another at the axial extensions. The outer housing halves are attached to the inner housing halves by the attachment elements introduced into the passthrough openings.

6 Claims, 1 Drawing Sheet

COMPRESSOR UNIT

FIELD OF THE INVENTION

The invention refers to a compressor unit and more particularly to a compressor unit which can accommodate numerous component compressors of varying sizes.

BACKGROUND OF THE INVENTION

A compressor unit is known from DE-U-92 15 231. In this prior compressor unit, a centering rim is provided on the individual housing halves which is radially outside the housing region forming the side channel. When the individual side-channel compressors are assembled into a unit, the side-channel compressors are centered with respect to one another by the respective inner housing halves which engage in one another via their centering rims. Attachment of the housing halves belonging to each side-channel compressor occurs via attachment brackets provided on the outer periphery of these housing halves into which attachment screws are inserted. The attachment brackets adjoin the inner parting plane of the two housing halves. For attachment of the side-channel compressors themselves, there are provided, on the outer periphery of the mutually facing housing halves of these side-channel compressors, attachment brackets adjoining the outer parting plane of those housing halves, into which attachment screws are once again inserted. With this type of attachment, only compressors with identical outside dimensions can be joined together into a unit.

SUMMARY OF THE INVENTION

The present invention reconfigures a compressor unit of the generic type in such a way that side-channel compressors with both identical housing dimensions and different housing diameters can be combined into a single compressor unit.

This is achieved by means of the following construction. The side-channel compressors are centered by means of the axial extensions provided on the housing wall which extends between the axial hub extension and the side channel protrusion. Because of this, it is also possible to assemble side-channel compressors with different housing diameters into a compressor unit. All that is necessary is for the axial extensions on the individual side-channel compressors to be configured with the same diameter. This is usually possible because of the space available between the axial hub extension and the housing protrusion for the side channel.

When the side-channel compressor is attached to a compressor unit, distortion of the housing parts is prevented by the fact that axially oriented bracing elements are provided, radially adjacent to the attachment elements and projecting, at least at the inner housing halves, into the housing parting plane. Advantageously, a circumferential bracing ring can be configured on the housing halves in this context.

Identical configuration, in terms of casting technology, of all housing halves of side-channel compressors that are to be combined into a compressor unit, is made possible by the fact that in all housing halves, the axial extension is located on the same radius as the axial extension necessary for coupling the respective outer housing half to the housing of the drive motor of the compressor unit. When the side-channel compressors belonging to a unit are of the same size, their housing halves can be configured identically in terms of their basic structure. The bearing receptacle required on the one outer housing half can be achieved by means of a corresponding replaceable mold insert in the casting mold.

DETAILED DESCRIPTION

Figure 1:
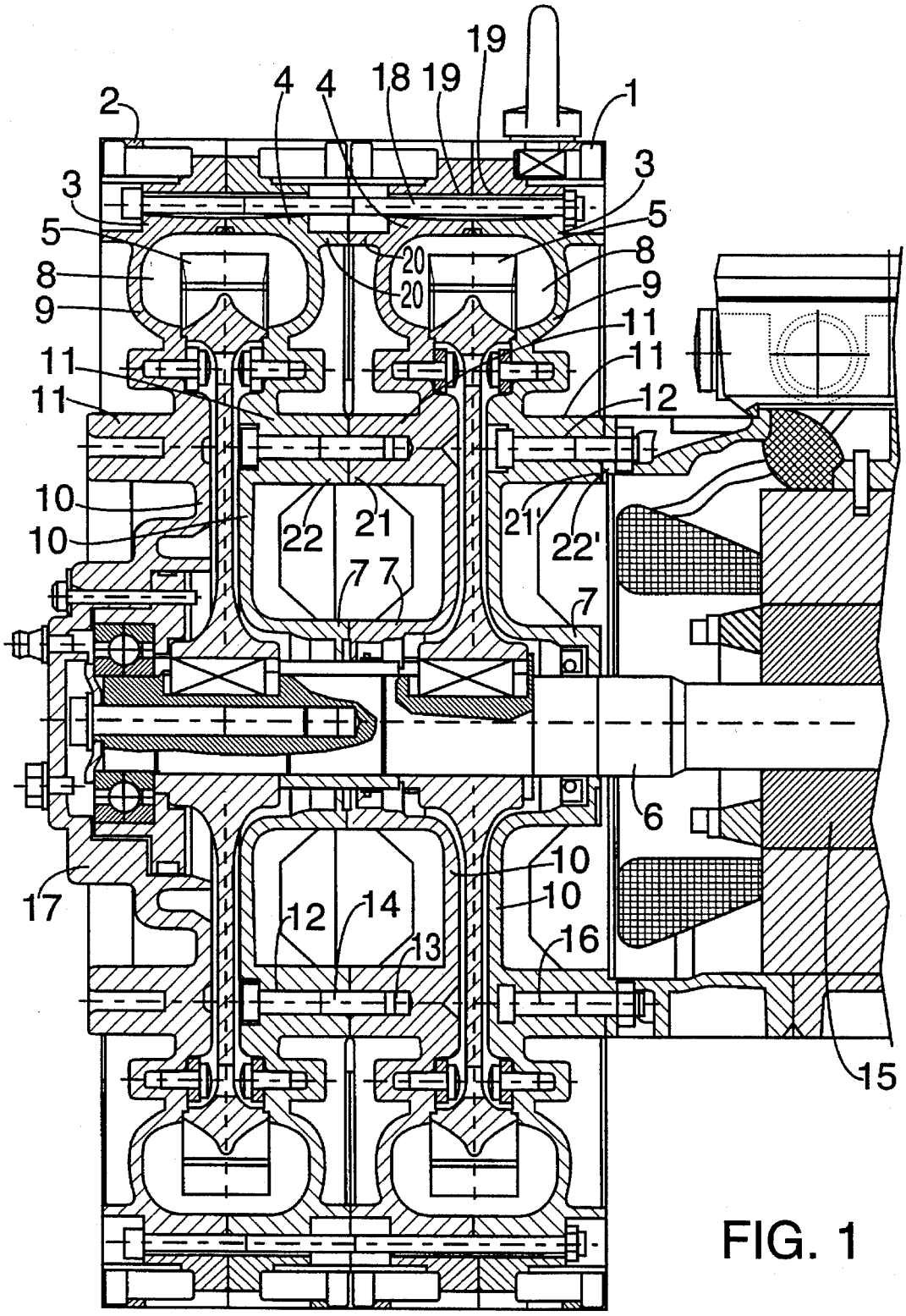
FIG. 1 shows an exemplary embodiment of a compressor unit according to the invention having two side-channel compressors.

A first side-channel compressor is designated 1, and a second 2. The housing of each side-channel compressor 1, 2 includes an outer housing half 3 and an inner housing half 4. When assembled, housing halves 3 and 4 each enclose impeller 5 of side-channel compressor 1, 2.

An axial extension 11 is shaped onto each housing half 3, 4 on the housing wall 10. This axial extension 11 extends between an axial hub extension 7 surrounding drive shaft 6 of impellers 5, and protrusion 9. In part, this forms the respective side channel 8. Axial extensions 11 of the two inner housing halves 4 serve to attach these two housing halves 4 to each other. Axial extension 11 connected to housing half 4 is therefore equipped with passthrough holes 12, and axial extension 11 connected to the other housing half 4 has threaded holes 13. The two inner housing halves 3 can thus be attached to one another with screws 14. Axial extension 11 can be configured as a circumferential ring or as a series of individual projections.

Axial extension 11, provided on outer housing half 3 of first side-channel compressor 1 and facing toward drive motor 15, is used to mount the compressor unit to the housing of drive motor 15. For this purpose, passthrough holes 12 are once again provided in the axial extension 11, and threaded holes 13 are provided in the motor housing, so that outer housing half 3 of first side-channel compressor 1 can be mounted on the motor housing by means of attachment screws 16.

A bearing receptacle 17, in which the free end of drive shaft 6 is mounted, is provided on outer housing half 3 of second side-channel compressor 2. For reasons of uniformity, an axial extension 11 is also provided on this housing half, although it has no further special here.

Attachment of outer housing halves 3 of second side-channel compressor 2 occurs by means of clamping bolts 18 inserted in passthrough openings 19 provided on the outer periphery of all housing halves 3 and 4. Clamping bolts 18 extend axially over all housing halves 3 and 4, and thus represent an additional fastening element for all housing halves 3 and 4. To prevent distortion of housing halves 3 and 4 by clamping bolts 18 engaging radially and externally on them, a bracing ring 20 is provided on the outside of housing halves 3 and 4, which is adjacent to clamping bolts 18 and passthrough openings 19. For reasons of uniformity, this bracing ring 20 is shaped onto each housing half 3, 4. Bracing rings 20 are dimensioned, in terms of their axial extent, in such a way that when inner housing halves 2 are attached, bracing rings 20 provided on the two inner housing halves 4 are in contact with each other. As a result, no distortion of the housings of the two side-channel compressors 1 and 2 is possible when clamping bolts 18 are installed.

When inner housing half 4 of second side-channel compressor 2 is assembled to inner housing half 4 of first side-channel compressor 1, these two housing halves 4 are aligned by means of a centering rim 21', provided on axial extension 11 of one of the inner housing halves 4, which rim engages in a centering step 22 present on axial extension 11 of the other inner housing half 4. Similarly, centering of outer housing halves 3 of first side-channel compressor 1 on the motor housing occurs by means of a centering rim 21', provided on axial extension 11 of this housing half 3, which engages in a corresponding centering step 22' of the motor housing.

As is evident from the drawing, the axial extensions on all housing halves 3 and 4 lie on the same radius, regardless of whether they serve to attach housing halves 4 to one another, or to attach the compressor unit to drive motor 15. This results in an identical configuration for all housing halves 3 and 4 in terms of their casting design. Bearing receptacle 17 on one outer housing half 3 can be implemented by a corresponding replaceable mold insert that can be inserted into the casting mold.

I claim:

1. A compressor unit, comprising a plurality of side channel compressors disposed in an axially adjacent manner, each of said side channel compressors including:

a housing having:

at least a outer and inner housing half, each of said outer and inner housing half having an outer periphery, such that said outer housing half is connected to said inner housing half by attachment elements introduced through a passthrough opening;

a housing wall;

a housing protrusion;

an axial extension coupled to said housing wall, said axial extension located between an axially extending hub extension and said housing protrusion, such that the axial extension for each side channel compressor lies at the substantially the same radius and extends into a parting plane of the outer and inner housing halves;

a centering rim located on said outer housing half, projecting beyond the parting plane, for matingly engaging a centering step on the axial extension of said inner housing half;

wherein the inner housing half of a side channel compressor is attached to the inner housing half of another side channel compressor at the axial extension.

2. The compressor unit of claim 1, further comprising a plurality of axially oriented bracing elements projecting into the housing parting plane which are radially adjacent to the said attachment elements.

3. The compressor unit of claim 2, wherein the bracing elements are configured as a circumferential bracing ring.

4. The compressor unit of claim 1, wherein on all outer and inner housing halves, the axial extension lies on the same radius as the axial extension required for coupling the outer housing half to a housing of a drive motor of the compressor unit.

5. The compressor unit of claim 2, wherein on all outer and inner housing halves, the axial extension lies on the same radius as the axial extension required for coupling the outer housing half to a housing of a drive motor of the compressor unit.

6. The compressor unit of claim 3, wherein on all outer and inner housing halves, the axial extension lies on the same radius as the axial extension required for coupling the outer housing half to a housing of a drive motor of the compressor unit.

* * * * *